US008540497B2

(12) United States Patent
Chang

(10) Patent No.: US 8,540,497 B2
(45) Date of Patent: Sep. 24, 2013

(54) FAN SELF-COOLING STRUCTURE WITH HEAT PIPE

(75) Inventor: Shu-Kang Chang, Sinjhuang (TW)

(73) Assignee: Asia Vital Components Co., Ltd., Taipei County (TW)

( * ) Notice: Subject to any disclaimer, the term of this patent is extended or adjusted under 35 U.S.C. 154(b) by 314 days.

(21) Appl. No.: 12/855,950

(22) Filed: Aug. 13, 2010

(65) Prior Publication Data

US 2012/0039732 A1 Feb. 16, 2012

(51) Int. Cl.
*H02K 9/22* (2006.01)

(52) U.S. Cl.
USPC ..... 417/423.8; 417/423.14; 361/679.47; 361/700; 310/64; 174/252

(58) Field of Classification Search
USPC ..... 417/423.7, 423.8, 354, 423.14; 310/89, 310/64, 71; 174/252, 15.1, 15.2, 16.1, 16.2, 174/16.3; 361/679.52, 700, 720, 679.47; 257/714, 715; 165/80.4, 80.5
See application file for complete search history.

(56) References Cited

U.S. PATENT DOCUMENTS

| | | | | |
|---|---|---|---|---|
| 6,315,529 | B1 | 11/2001 | Hu | |
| 7,442,005 | B2 * | 10/2008 | Yeh et al. | 415/200 |
| 7,554,227 | B2 * | 6/2009 | Horng et al. | 310/64 |
| 7,563,070 | B2 * | 7/2009 | Lin et al. | 415/118 |
| 7,567,000 | B2 * | 7/2009 | Sugiyama et al. | 310/64 |
| 8,206,104 | B2 * | 6/2012 | Horng et al. | 415/215.1 |
| 2005/0116554 | A1 * | 6/2005 | Dano et al. | 310/58 |
| 2007/0075598 | A1 * | 4/2007 | Tung et al. | 310/67 R |
| 2007/0145842 | A1 * | 6/2007 | Zhu et al. | 310/88 |
| 2007/0252451 | A1 * | 11/2007 | Shibuya et al. | 310/64 |
| 2008/0053639 | A1 * | 3/2008 | Lin et al. | 165/80.3 |
| 2011/0108251 | A1 * | 5/2011 | Horng | 165/121 |
| 2012/0085519 | A1 * | 4/2012 | Chou | 165/104.26 |

* cited by examiner

*Primary Examiner* — Devon Kramer
*Assistant Examiner* — Nathan Zollinger

(57) ABSTRACT

A fan self-cooling structure with heat pipe includes a stator assembly, a fan circuit board, and at least one heat pipe. The fan circuit board is flatly connected to a bottom end of the stator assembly and has at least one heat-producing electronic element provided thereon. The at least one heat pipe is provided on the fan circuit board for absorbing and transferring heat energy produced by the at least one electronic element. With these arrangements, it is able to lower the temperature of the electronic elements in a fan and enhance the characteristics of the fan.

7 Claims, 9 Drawing Sheets

FAN SELF-COOLING STRUCTURE WITH HEAT PIPE

FIELD OF THE INVENTION

The present invention relates to a fan self-cooling structure, and more particularly to a fan self-cooling structure with heat pipe for lowering the temperature of the electronic elements in a fan and enhancing the characteristics of the fan.

BACKGROUND OF THE INVENTION

In recent years, with the development in the electronic industrial field, all kinds of electronic devices have quickly upgraded performance and largely increased computing speed. To enable constantly increased computing speed, the number of chips included in the chip set inside the electronic devices also increases. These chips would produce a large amount of heat when they work, and the produced heat must be timely removed from the chips to avoid any adverse influence on the performance of the electronic devices, such as reducing the computing speed of the electronic devices. Moreover, heat accumulated inside the electronic devices would cause burnout thereof. Therefore, it has become an important issue to efficiently dissipate the heat from the electronic devices.

Among various kinds of heat dissipating devices, the cooling fan is able to quickly remove the heat absorbed by the radiation fins to enable good air circulation and accordingly, has become a requisite part of most electronic devices.

Conventionally, the cooling fan mainly includes a rotor assembly, a stator assembly, and a fan circuit board. The rotor assembly is located to one side of the stator assembly, and the fan circuit board is located to the other side of the stator assembly opposite to the rotor assembly. The stator assembly includes a silicon steel seat and a plurality of insulating posts radially outward extended from the silicon steel seat. The insulating posts each are wounded by an enamel wire, which is electrically connected to the fan circuit board and electronic elements provided thereon. When the cooling fan is driven to rotate, the fan circuit board and the electronic elements thereon are electrically connected to one another to thereby drive the enamel wires wound around the insulating posts to generate magnetic polarities. The rotor assembly rotates under the effect of the magnetic polarities generated by the enamel wires. The electronic elements would produce heat and have higher temperature while driving the enamel wires to generate magnetic polarities. However, in the conventional cooling fan structure, there is not any means nearby the electronic elements for dissipating the heat produced by the electronic elements. Thus, the produced heat would accumulate on the fan circuit board and the electronic elements thereon to adversely affect the operation performance of the cooling fan, resulting in damaged electronic elements and shortened service life thereof.

In brief, the conventional cooling fan has the following disadvantages: (1) the fan circuit board and the electronic elements thereon are subject to poor heat dissipation; (2) the operation performance of the cooling fan is adversely affected; and (3) the electronic elements thereof are subject to damage and shortened service life.

SUMMARY OF THE INVENTION

It is therefore a primary object of the present invention to provide a fan self-cooling structure with heat pipe for lowering the temperature of electronic elements mounted on a fan circuit board.

Another object of the present invention is to provide a fan self-cooling structure with heat pipe for enhancing the characteristics of a fan.

To achieve the above and other objects, the fan self-cooling structure with heat pipe provided according to a preferred embodiment of the present invention includes a stator assembly, a fan circuit board, and at least one heat pipe. The fan circuit board is flatly connected to a bottom end of the stator assembly and has at least one heat-producing electronic element provided thereon. The at least one heat pipe is provided on the fan circuit board for absorbing and transferring heat energy produced by the at least one electronic element. With these arrangements, it is able to lower the temperature of the electronic elements in a fan and enhance the characteristics of the fan.

To achieve the above and other objects, the fan self-cooling structure with heat pipe provided according to another preferred embodiment of the present invention includes a stator assembly, a fan circuit board, a heat plate, and at least one heat pipe. The fan circuit board is flatly connected to a bottom end of the stator assembly and has at least one heat-producing electronic element provided thereon. The heat plate has a first side correspondingly contacting with the at least one heat-producing electronic element and an opposite second side contacting with the at least one heat pipe. Thus, the heat plate absorbs the heat energy produced by the electronic element and transfers the absorbed heat energy to the heat pipe. The heat energy transferred by the heat pipe is finally dissipated from the heat pipe into ambient air to thereby lower the temperature of the electronic elements in a fan and enhance the characteristics of the fan.

Therefore, the present invention has the following advantages: (1) lowering the temperature of the electronic elements in a fan; and (2) enhancing the characteristics of the fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
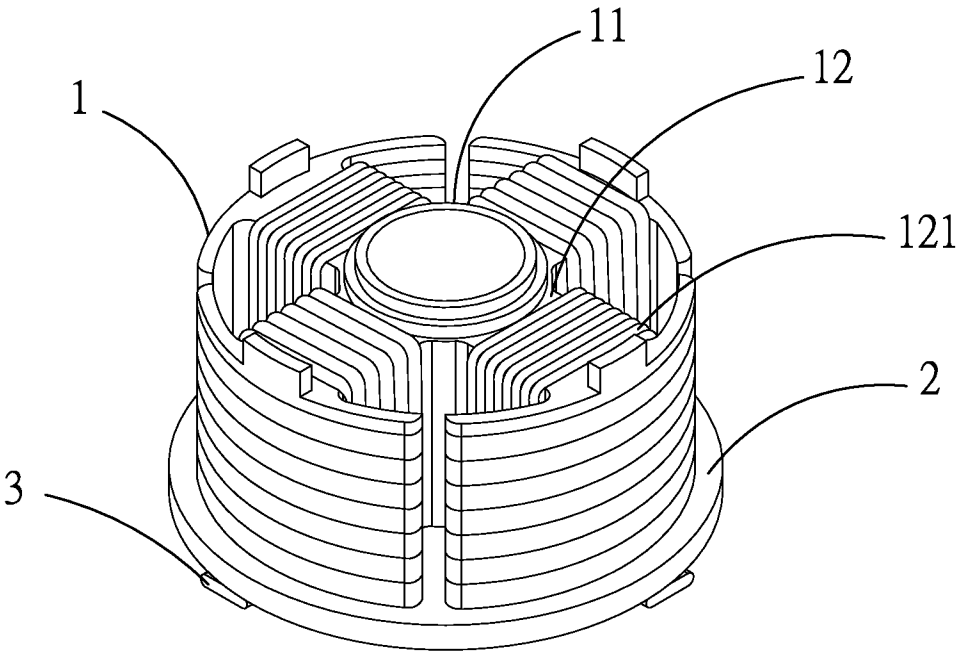
FIG. 1 is a top perspective view of a fan self-cooling structure with heat pipe according to a first preferred embodiment of the present invention.

The present invention will now be described with some preferred embodiments thereof by referring to the accompanying drawings. For the purpose of easy to understand, elements that are the same in the preferred embodiments are denoted by the same reference numerals.

Figure 2:
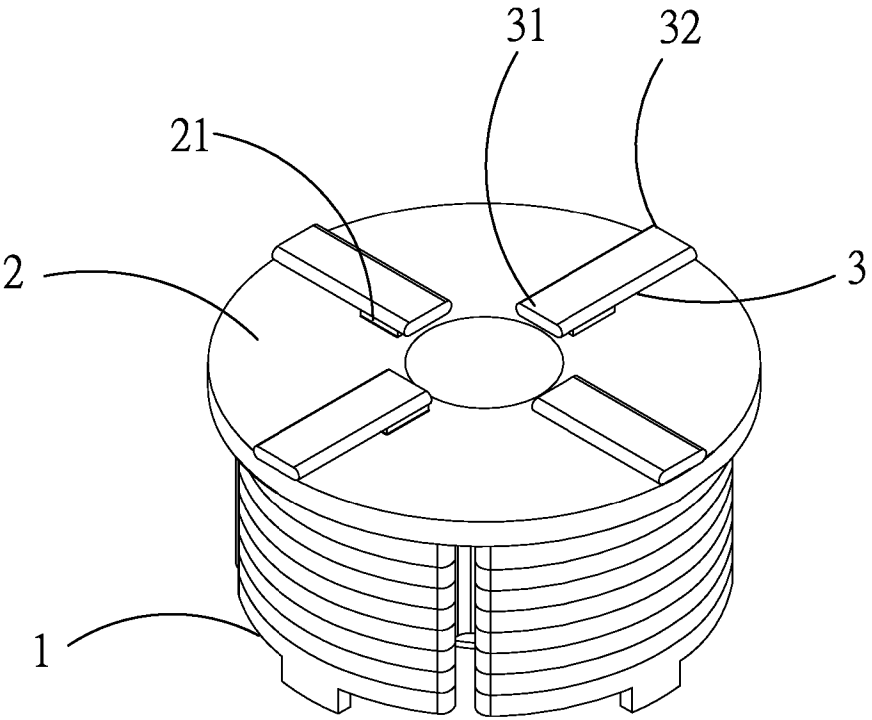
FIG. 2 is a bottom perspective view of the fan self-cooling structure with heat pipe according to the first preferred embodiment of the present invention.

Please refer to FIGS. 1 and 2 that are top and bottom perspective views, respectively, of a fan self-cooling structure with heat pipe according to a first preferred embodiment of the present invention. As shown, in the first preferred embodiment, the fan self-cooling structure includes a stator assembly 1, a fan circuit board 2, and at least one heat pipe 3. In the illustrated preferred embodiment, there are four heat pipes 3. The stator assembly 1 includes a silicon steel seat 11, from which a plurality of insulating posts 12 is radially outward extended (four insulting posts 12 are shown in the drawings). Each of the insulating posts 12 has a coil 121 wound therearound. The fan circuit board 2 is flatly connected to a bottom end of the stator assembly 1 to electrically connect to the coils 121, and there is at least one heat-producing electronic element 21 provided on the fan circuit board 2. The heat pipes 3 are provided on the fan circuit board 2 corresponding to the heat-producing electronic elements 21, and each include a heat-absorbing section 31 and a heat-dissipating section 32. As can be seen from FIG. 2, the heat-absorbing section 31 of each heat pipe 3 is in contact with one side of the heat-producing electronic element 21 to transfer the heat produced by the electronic element 21 to the heat-dissipating section 32, from where the heat is dissipated into ambient air. In the illustrated first preferred embodiment, the heat-dissipating sections 32 of the heat pipes 3 are not extended beyond an outer periphery of the fan circuit board 2.

Figure 3:
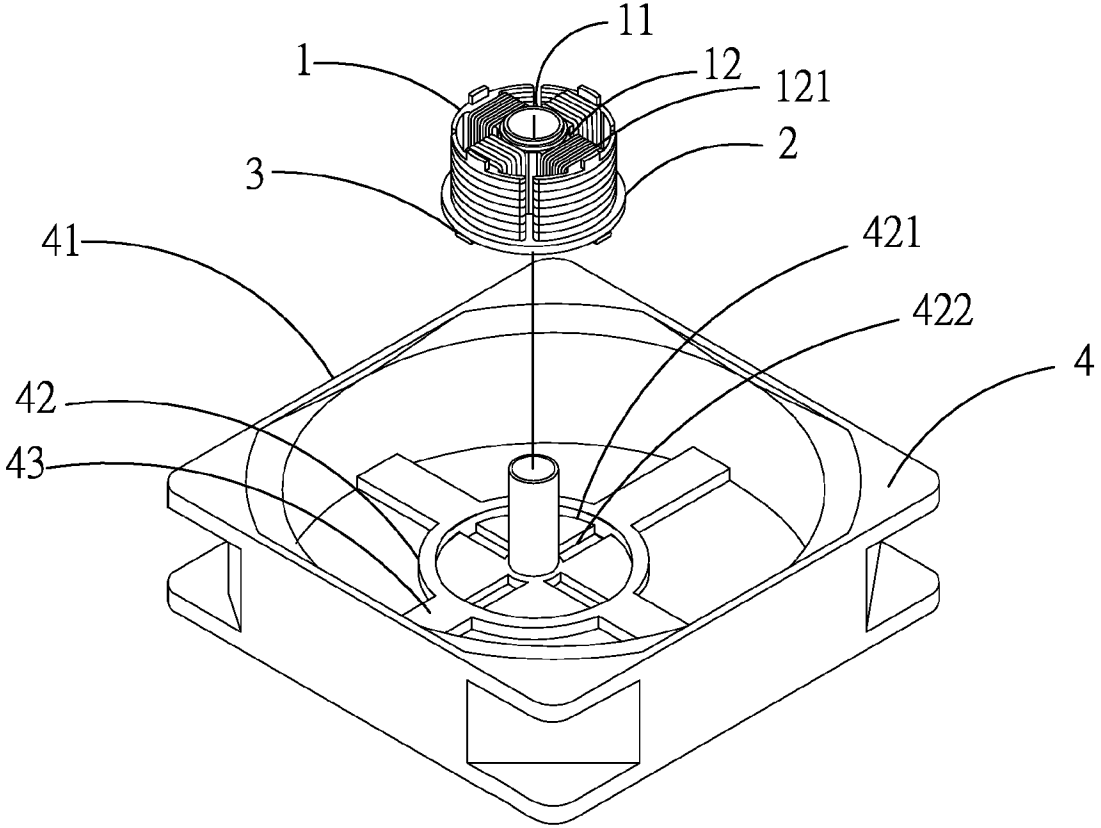
FIG. 3 is an exploded perspective view showing the use of the fan self-cooling structure according to the first preferred embodiment of the present invention.
Figure 4:
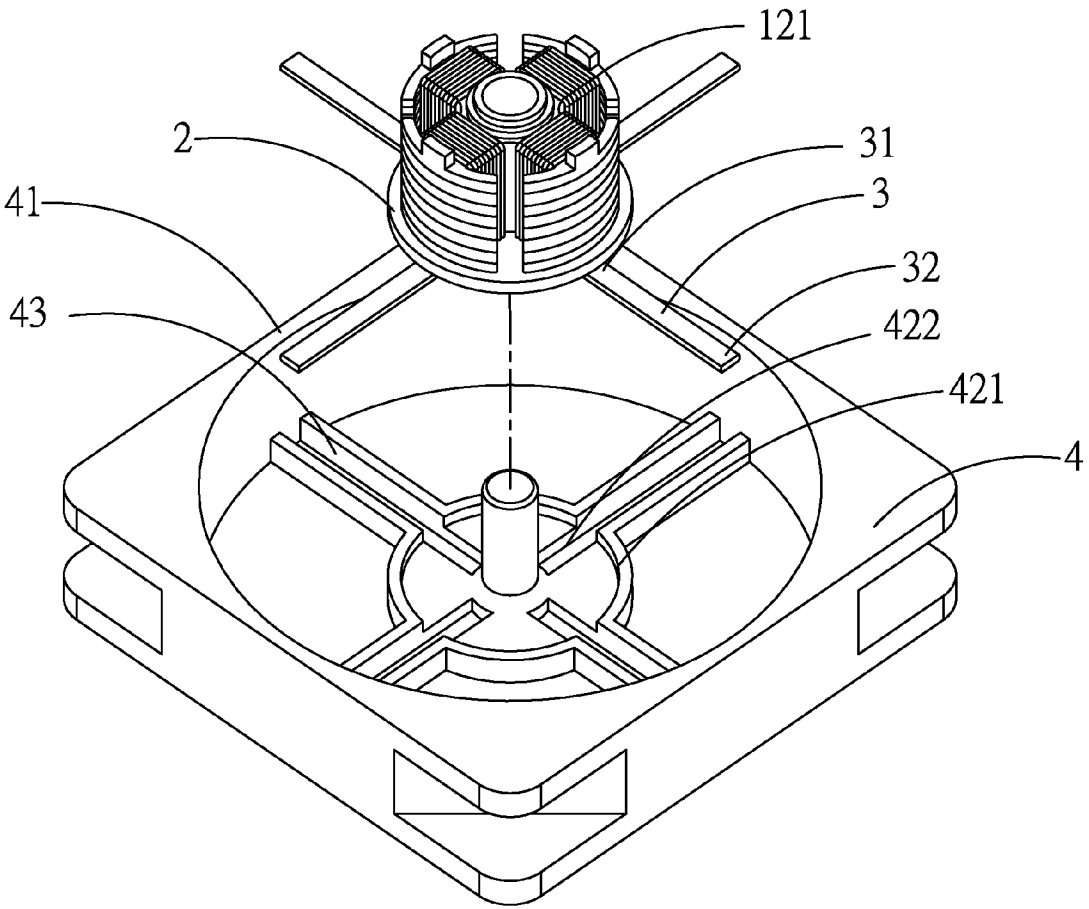
FIG. 4 is an exploded perspective view showing the use of a variant of the fan self-cooling structure with heat pipe according to the first preferred embodiment of the present invention.
Figure 5:
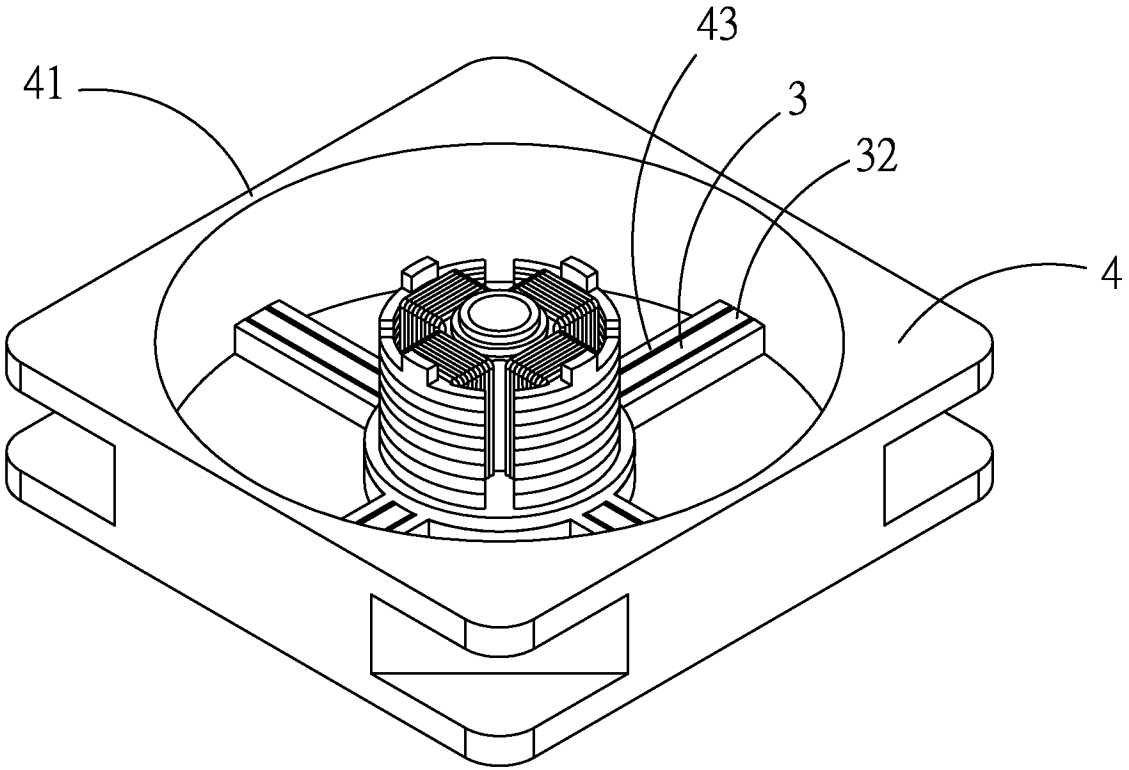
FIG. 5 is an assembled view of FIG. 4.

Please refer to FIGS. 3 to 5 that show the use of the fan self-cooling structure with heat pipe according to the first preferred embodiment of the present invention. As shown, the fan self-cooling structure is assembled to a fan framework 4, which has an outer frame 41 and a base 42. The base 42 defines a first recess 421 therein, from which a plurality of ribs 43 is radially outward extended to connect at respective distal end to an inner side of the outer frame 41 (four ribs 43 are shown in the drawings). Further, at least one second recess 422 is formed in the first recess 421 (four second recesses 422 are shown in the drawings).

The stator assembly 1 is mounted on the base 42, such that the fan circuit board 2 connected to the bottom end of the stator assembly 1 is received in the first recess 421 of the base 42 with the heat pipes 3 correspondingly received in the second recesses 422.

In a variant of the first preferred embodiment as shown in FIGS. 4 and 5, the heat-dissipating sections 32 of the heat pipes 3 are extended beyond the outer periphery of the fan circuit board 2. In this case, the second recesses 422 are separately extended from the first recess 421 into the ribs 43. That is, the fan circuit board 2 is received in the first recess 421 with the heat pipes 3 correspondingly received in the second recesses 422 and extended from the fan circuit board 2 into the ribs 43. More specifically, the heat-dissipating sections 32 of the heat pipes 3 are extended along the ribs 43 to the outer frame 41. In the case of a metal-made fan framework 4, the heat transferred via the heat-dissipating sections 32 extended to the outer frame 41 can be dissipated into ambient air from the outer frame 41.

When the fan circuit board 2 and the heat-producing electronic elements 21 are electrically connected to one another, the coils 121 wound around the insulating posts 12 are caused to generate magnetic polarities. The heat energy produced by the electronic elements 21 during the operation thereof is absorbed and transferred by the heat-absorbing sections 31 of the heat pipes 3 to the heat-dissipating sections 32. The heat is then dissipated from the heat-dissipating sections 32 into ambient air to achieve the effects of lowering the temperature of the electronic elements 21 on the fan circuit board 2 and enhancing the fan characteristics. Further, when a fan (not shown) assembled to the stator assembly 1 is driven via the coils 121 to produce air flows, the air flows can also carry the heat away from the heat-dissipating sections 32 that are extended to the outer frame 41.

Figure 6:
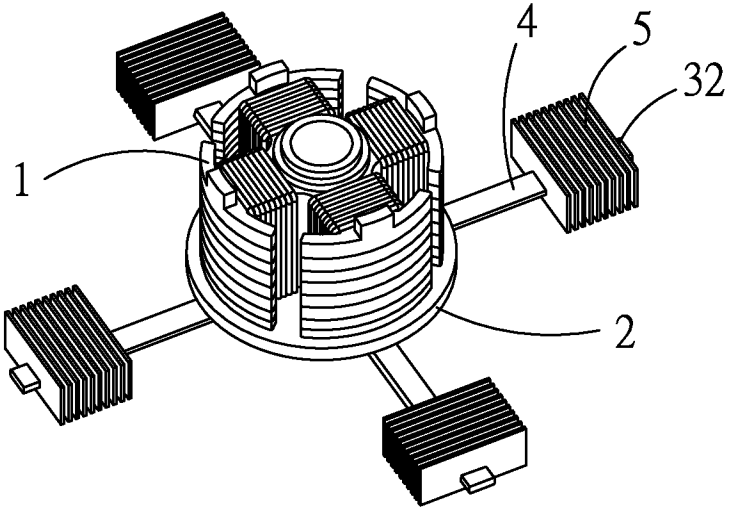
FIG. 6 is a perspective view of a fan self-cooling structure with heat pipe according to a second preferred embodiment of the present invention.
Figure 7:
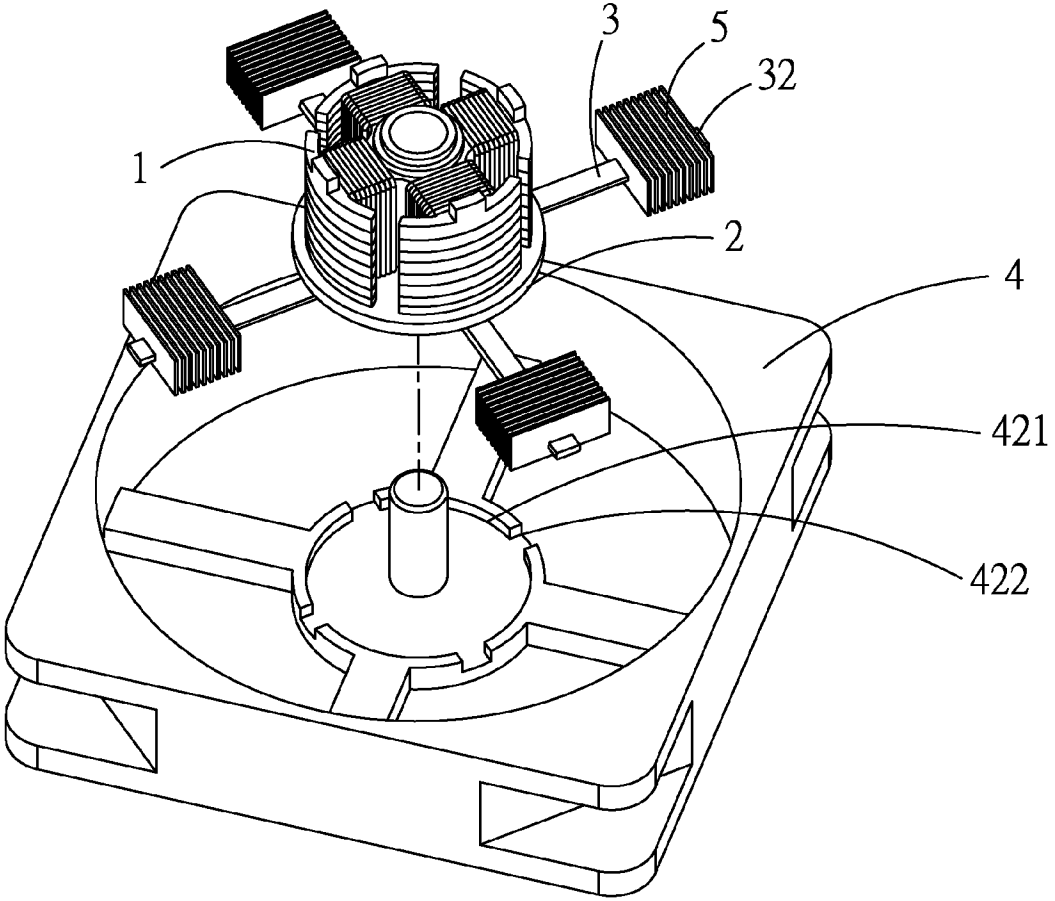
FIG. 7 is an exploded perspective view showing the use of the fan self-cooling structure with heat pipe according to the second preferred embodiment of the present invention.

FIGS. 6 and 7 illustrate a second preferred embodiment of the present invention. Since the fan self-cooling structure in the second preferred embodiment has overall structure and element connection manner generally similar to the first preferred embodiment, the portions of the second embodiment that are the same as the first embodiment are not repeatedly discussed herein. The second embodiment is different from the first embodiment in that a plurality of radiation fins 5 is assembled to each of the heat-dissipating sections 32 of the heat pipes 3 that are extended beyond the fan circuit board 2. The heat transferred to the heat pipes 3 can be further efficiently radiated into ambient air via the radiation fins 5. In the fan framework 4 to be used with the fan self-cooling structure of the second preferred embodiment, each of the second recesses 422 is provided on the first recess 421 at a position between two adjacent ribs 43, so that the heat pipes 3 are correspondingly received in the second recesses 422. Similarly, when a fan (not shown) assembled to the stator assembly 1 is driven via the coils 121 to produce air flows, the air flows can also carry the heat away from the heat-dissipating sections 32 and the radiation fins 5.

Figure 8:
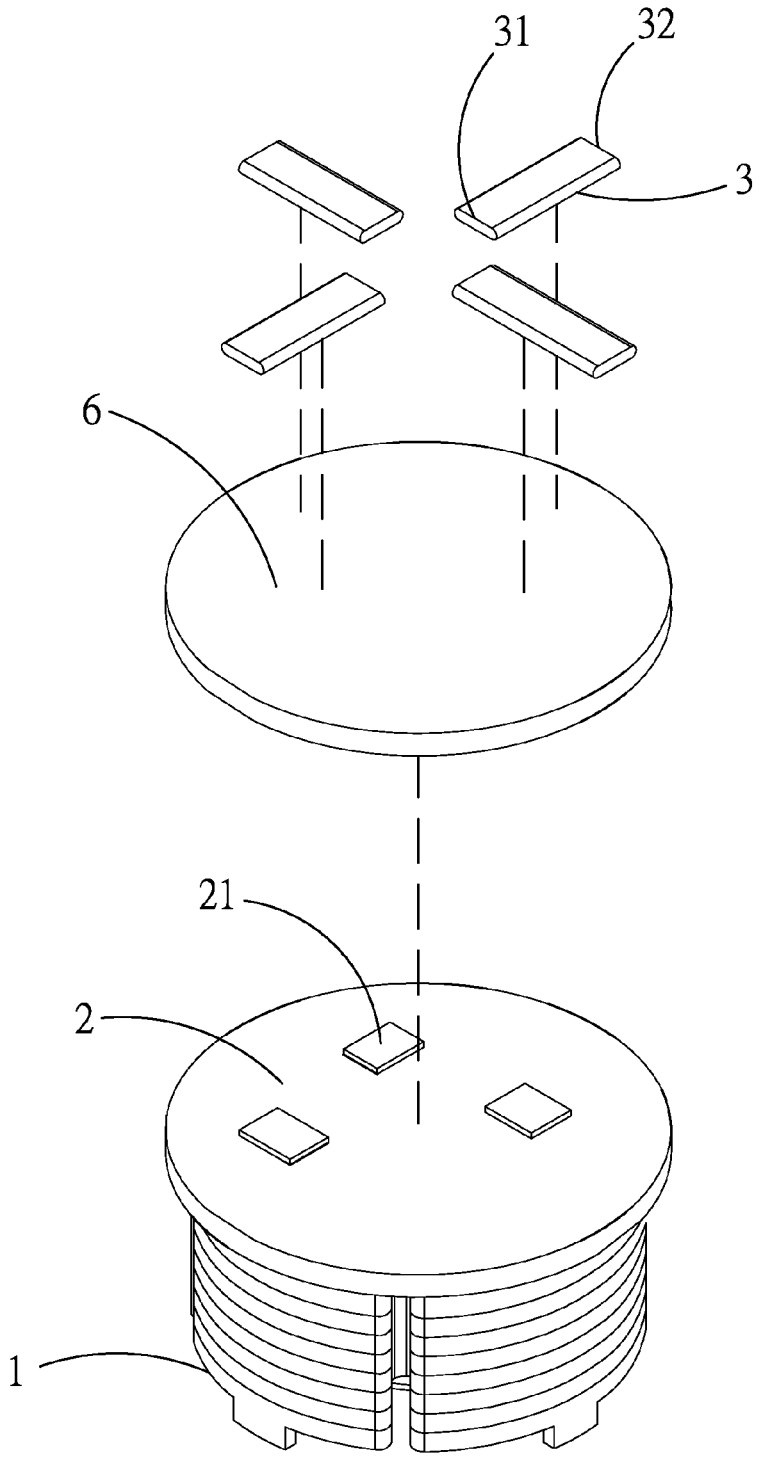
FIG. 8 is an exploded perspective view of a fan self-cooling structure with heat pipe according to a third preferred embodiment of the present invention.
Figure 9:
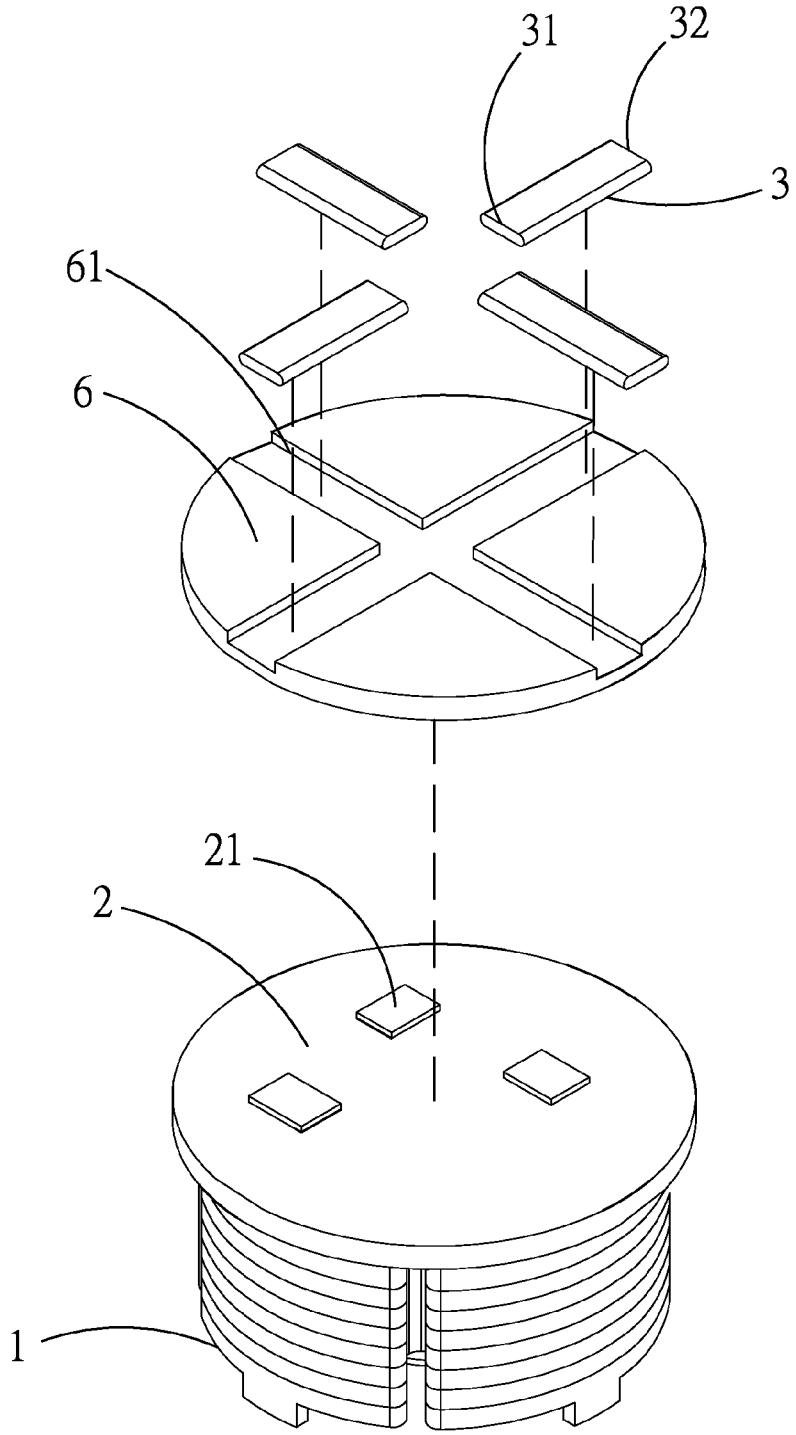
FIG. 9 is an exploded perspective view of a variant of the fan self-cooling structure with heat pipe according to the third preferred embodiment of the present invention.

FIGS. 8 and 9 illustrate a third preferred embodiment of the present invention. Since the fan self-cooling structure in the third preferred embodiment has overall structure and element connection manner generally similar to the first preferred embodiment, the portions of the third embodiment that are the same as the first embodiment are not repeatedly discussed herein. The third embodiment is different from the first embodiment in that a heat plate 6 having a first side attached to the fan circuit board 2 on the side having the electronic elements 21 provided thereon. The heat plate 6 is capable of absorbing the heat energy produced by the electronic elements 21, and transferring the absorbed heat to the heat pipes 3, which are attached to an opposite second side of the heat plate 6, so that the heat is finally dissipated from the heat pipes 3.

As can be seen from FIG. 8, the second side of the heat plate 6 having the heat pipes 3 attached thereto is a plane surface. On the other hand, according to a variant of the third embodiment as shown in FIG. 9, the heat plate 6 is provided on the second side with a plurality of grooves 61 for fixedly receiving the heat pipes 3 therein. Similarly, the heat energy absorbed by the heat plate 6 is transferred to and dissipated from the heat pipes 3.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan self-cooling structure with a heat pipe feature, comprising:

a stator assembly;

a fan circuit board being connected to a bottom end of the stator assembly and having at least one heat-producing electronic element provided thereon;

at least one heat pipe being provided on a bottom side of the fan circuit board, oriented in a radial direction and dedicated to absorbing and transferring heat energy produced by the at least one electronic element;

wherein the fan self-cooling structure is assembled to a fan framework; wherein the fan framework includes an outer frame and a base; the base defining a central first recess therein, the first recess corresponding to the fan circuit board connected to said stator assembly for connecting with one side of the fan circuit board; and wherein the first recess is provided therein with at least one second recess corresponding to and for receiving the at least one heat pipe.

2. The fan self-cooling structure with a heat pipe feature as claimed in claim 1, wherein the heat pipe has a heat-absorbing section and a heat-dissipating section; the heat-absorbing section being in contact with the heat-producing electronic element for transferring the heat energy produced by the electronic element to the heat-dissipating section, so that the heat energy is dissipated from the heat-dissipating section into ambient air.

3. The fan self-cooling structure with a heat pipe feature as claimed in claim 1, wherein the stator assembly includes a silicon steel seat, from which a plurality of insulating posts is radially outward extended.

4. The fan self-cooling structure with a heat pipe feature as claimed in claim 3, wherein the insulating posts each have a coil wound therearound.

5. The fan self-cooling structure with a heat pipe feature as claimed in claim 4, wherein the coils are electrically connected to the fan circuit board.

6. The fan self-cooling structure with a heat pipe feature as claimed in claim 1, wherein the at least one heat pipe has a distal end in contact with the outer frame of the fan framework, and the heat energy transferred by the heat pipe to the heat dissipating section is dissipated from the outer frame.

7. The fan self-cooling structure with a heat pipe feature as claimed in claim 6, wherein the fan framework is a metal-made framework.

* * * * *